US008330668B2

(12) United States Patent
Deng et al.

(10) Patent No.: US 8,330,668 B2
(45) **Date of Patent: *Dec. 11, 2012**

(54) DUAL STAGGER OFF SETTABLE AZIMUTH BEAM WIDTH CONTROLLED ANTENNA FOR WIRELESS NETWORK

(75) Inventors: Gang Yi Deng, Irvine, CA (US); Bill Vassilakis, Orange, CA (US); Matthew J. Hunton, Liberty Lake, WA (US); Alexander Rabinovich, Cypress, CA (US); Nando Hunt, Newport Beach, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 323 days.

This patent is subject to a terminal disclaimer.

(21) Appl. No.: 12/080,483

(22) Filed: Apr. 3, 2008

(65) Prior Publication Data

US 2008/0246681 A1 Oct. 9, 2008

Related U.S. Application Data

(60) Provisional application No. 60/922,130, filed on Apr. 6, 2007.

(51) Int. Cl.
*H01Q 19/06* (2006.01)
*H01Q 3/12* (2006.01)
*H01Q 21/00* (2006.01)

(52) U.S. Cl. ..... 343/754; 343/761; 343/835; 343/839; 343/853; 343/893; 343/796; 343/797

(58) Field of Classification Search ..... 343/754, 343/761, 835, 839, 853
See application file for complete search history.

(56) References Cited

U.S. PATENT DOCUMENTS

| | | | | |
|---|---|---|---|---|
| 1,795,397 | A | 3/1931 | Hoyt | |
| 2,473,421 | A | 5/1945 | Fubini et al. | |
| 2,535,049 | A | 12/1950 | De Rosa | |
| 5,274,391 | A | 12/1993 | Connolly | |
| 5,572,222 | A | 11/1996 | Mailandt et al. | |
| 5,949,303 | A | 9/1999 | Arvidsson et al. | |
| 5,966,102 | A * | 10/1999 | Runyon | 343/820 |
| 5,969,689 | A | 10/1999 | Martek et al. | |
| 6,034,649 | A | 3/2000 | Wilson et al. | |
| 6,067,053 | A | 5/2000 | Runyon et al. | |
| 6,285,336 | B1 | 9/2001 | Zimmerman | |
| 6,515,633 | B2 | 2/2003 | Ippolito | |
| 6,529,172 | B2 | 3/2003 | Zimmerman | |

(Continued)

FOREIGN PATENT DOCUMENTS

EP 0566522 10/1993

(Continued)

OTHER PUBLICATIONS

International Search Authority, Written Opinion pertaining to Application No. PCT/US08/04332 mailed Jun. 20, 2008.

(Continued)

*Primary Examiner* — Trinh Dinh
(74) *Attorney, Agent, or Firm* — OC Patent Law Group

(57) ABSTRACT

An antenna adapted for wireless networks and having a variably controlled stagger antenna array architecture is disclosed. The antenna array contains a plurality of driven radiating elements that are spatially arranged having each radiating element or element groups orthogonally movable relative to a main vertical axis so as to provide a controlled variation of the antenna array's azimuth radiation pattern.

14 Claims, 8 Drawing Sheets

U.S. PATENT DOCUMENTS

| | | | | |
|---|---|---|---|---|
| 6,567,055 | B1 | 5/2003 | Oglesby | |
| 6,697,029 | B2 | 2/2004 | Teillet et al. | |
| 6,717,555 | B2 | 4/2004 | Teillet et al. | |
| 6,747,606 | B2 | 6/2004 | Harel et al. | |
| 6,756,939 | B2 | 6/2004 | Chen et al. | |
| 6,809,694 | B2 | 10/2004 | Webb et al. | |
| 6,822,618 | B2 | 11/2004 | Bisiules et al. | |
| 6,864,837 | B2 | 3/2005 | Runyon et al. | |
| 6,922,169 | B2 | 7/2005 | Izzat et al. | |
| 6,924,776 | B2 | 8/2005 | Le et al. | |
| 6,933,905 | B2 | 8/2005 | Ippolito | |
| 6,950,061 | B2 | 9/2005 | Howell et al. | |
| 6,985,123 | B2 * | 1/2006 | Gottl | 343/853 |
| 7,006,053 | B2 | 2/2006 | Zigler et al. | |
| 7,075,497 | B2 | 7/2006 | Teillet et al. | |
| 7,151,498 | B2 | 12/2006 | Bassily | |
| 7,173,572 | B2 * | 2/2007 | Teillet et al. | 343/797 |
| 7,358,922 | B2 | 4/2008 | Le et al. | |
| 7,405,710 | B2 | 7/2008 | Bisiules et al. | |
| 7,710,344 | B2 | 5/2010 | Deng et al. | |
| 2002/0008672 | A1 * | 1/2002 | Gothard et al. | 343/893 |
| 2002/0135528 | A1 * | 9/2002 | Teillet et al. | 343/797 |
| 2002/0149529 | A1 | 10/2002 | Fleming et al. | |
| 2004/0051677 | A1 * | 3/2004 | Gottl | 343/797 |
| 2005/0219140 | A1 | 10/2005 | Browne et al. | |
| 2005/0231437 | A1 | 10/2005 | Dai et al. | |
| 2007/0008236 | A1 * | 1/2007 | Tillery et al. | 343/797 |
| 2007/0030208 | A1 * | 2/2007 | Linehan | 343/757 |
| 2007/0146222 | A1 | 6/2007 | Mansour | |
| 2007/0205952 | A1 | 9/2007 | Deng et al. | |
| 2007/0241979 | A1 | 10/2007 | Yang | |
| 2008/0309568 | A1 * | 12/2008 | Deng et al. | 343/757 |
| 2009/0015498 | A1 | 1/2009 | Deng et al. | |
| 2009/0262039 | A1 * | 10/2009 | Lytle et al. | 343/797 |

FOREIGN PATENT DOCUMENTS

| | | |
|---|---|---|
| EP | 1098391 | 5/2001 |
| EP | 1950832 | 7/2008 |
| WO | 2005/060045 | 6/2005 |

OTHER PUBLICATIONS

International Search Authority, Written Opinion for International Application No. PCT/US08/02845 dated Jun. 2, 2008, 7 pages.

International Search Authority, Written Opinion for International Application No. PCT/US08/03176 dated Jun. 11, 2008, 8 pages.

Supplemental European Search Report pertaining to European Patent Application No. 07751869.4/PCT/2007005137 mailed Feb. 4, 2010.

Office Action dated Dec. 22, 2010 from U.S. Appl. No. 12/157,646.

Office Action dated Jul. 21, 2011 from U.S. Appl. No. 12/157,646.

* cited by examiner

A-A

A'-A'

DUAL STAGGER OFF SETTABLE AZIMUTH BEAM WIDTH CONTROLLED ANTENNA FOR WIRELESS NETWORK

RELATED APPLICATION INFORMATION

The present application claims priority under 35 USC section 119(e) to U.S. provisional patent application Ser. No. 60/922,130 filed Apr. 6, 2007, the disclosure of which is incorporated herein by reference in its entirety.

BACKGROUND OF THE INVENTION

1. Field of the Invention

The present invention relates in general to communication systems and components. More particularly the present invention is directed to antennas for wireless networks.

2. Description of the Prior Art and Related Background Information

Modern wireless antenna implementations generally include a plurality of radiating elements that may be arranged over a reflector plane defining a radiated (and received) signal beamwidth and azimuth scan angle. Azimuth antenna beamwidth can be advantageously modified by varying amplitude and phase of an RF signal applied to respective radiating elements. Azimuth antenna beamwidth has been conventionally defined by Half Power Beam Width (HPBW) of the azimuth beam of relative to a bore sight of such antenna array. In such an antenna array structure radiating element positioning is critical to the overall beamwidth control as such antenna systems rely on accuracy of amplitude and phase angle of RF signal supplied to each radiating element. This places a great deal of tolerance and accuracy on a mechanical phase shifter to provide required signal division between various radiating elements over various azimuth beamwidth settings.

Real world applications often call for an antenna array with beam down tilt and azimuth beamwidth control that may incorporate a plurality of mechanical phase shifters to achieve such functionality. Such highly functional antenna arrays are typically retrofitted in place of simpler, lighter and less functional antenna arrays while weight and wind loading of the newly installed antenna array can not be significantly increased. Accuracy of a mechanical phase shifter generally depends on its construction materials. Generally, highly accurate mechanical phase shifter implementations require substantial amounts of relatively expensive dielectric materials and rigid mechanical support. Such construction techniques result in additional size and weight not to mention being relatively expensive. Additionally, mechanical phase shifter configurations utilizing lower cost materials may fail to provide adequate passive intermodulation suppression under high power RF signal levels.

Consequently, there is a need to provide a simpler system and method to adjust antenna beamwidth control.

SUMMARY OF THE INVENTION

In a first aspect the present invention provides an antenna for a wireless network. The antenna comprises a generally planar reflector, a first plurality of radiators and a second plurality of radiators, wherein at least one of the first plurality of radiators and the second plurality of radiators are movable relative to the reflector in a direction generally parallel to the reflector plane, wherein the radiators are movable from a first configuration where the radiators are all aligned to a second configuration where the radiators are staggered relative to each other, to provide variable signal beamwidth.

In one preferred embodiment of the antenna the first and second plurality of radiators may comprise vertically polarized radiating elements. Alternatively, the first and second plurality of radiators may comprise dual polarization radiating elements arranged in groups of plural elements for each radiator. Alternatively, the first and second plurality of radiators may comprise dual polarization cross over dipole radiating elements. The antenna may further comprise a first plurality of radiator mount plates coupled to the first plurality of radiators and slidable relative to the reflector and a second plurality of radiator mount plates coupled to the second plurality of radiators and slidable relative to the reflector. The reflector preferably has a plurality of orifices and the first and second plurality of radiator mount plates are configured behind the orifices. The first and second plurality of radiator mount plates preferably comprise reflective material on the portion thereof facing the orifice. The antenna may further comprise one or more actuators coupled to the first and second plurality of radiator mount plates to slide the mount plates and attached radiators relative to the reflector. The antenna may further comprise a first and second plurality of guide frames coupled to the reflector adjacent the orifices and receiving the respective first and second plurality of radiator mount plates. The generally planar reflector may be defined by a Y-axis and a Z-axis parallel to the plane of the reflector and an X-axis extending out of the plane of the reflector, and the one or more actuators are configured to adjust Y-axis position of the first plurality of radiators and the second plurality of radiators in opposite directions. The reflectors in the first configuration may be aligned along a center line of the reflector parallel to the Z-axis of the reflector and spaced apart a distance VS in the Z direction, providing a relatively wide beamwidth setting. The reflectors in the second configuration may be offset in opposite Y directions from the center line of the reflector by a distance HS, to provide a narrower beamwidth, the offset defining a stagger distance (SD) defined by the following relationship:

$$SD=\sqrt{4HS^2+VS^2}$$

The distance SD is preferably less than about 1λ, where λ is the wavelength of the RF operating frequency of the antenna. The antenna may further comprise a multipurpose control port receiving azimuth beamwidth control signals provided to the one or more actuators.

In another aspect the present invention provides a mechanically variable azimuth beamwidth and electrically variable elevation beam tilt antenna. The antenna comprises a reflector, a first plurality of slidably mounted radiators adjacent the reflector, a second plurality of slidably mounted radiators adjacent the reflector, and at least one actuator coupled to the first and second radiators, wherein signal azimuth beamwidth is variable based on positioning of the first plurality of radiators and the second plurality of radiators relative to each other in the sliding direction. The antenna further comprises an input port coupled to a radio frequency (RF) power signal dividing-combining network for providing RF signals to the first plurality of radiators and the second plurality of radiators, wherein the signal dividing-combining network includes a phase shifting network for controlling elevation beam tilt by controlling relative phase of the RF signals applied to the radiators.

In a preferred embodiment, the antenna further comprises a multipurpose port coupled to the actuator and signal dividing-combining network to provide beamwidth and beam tilt control signals to the antenna.

In another aspect the present invention provides a method of adjusting signal beamwidth in a wireless antenna having a plurality of radiators at least some of which are movable in a direction generally parallel to a plane of the reflector. The method comprises adjusting the radiators in a direction generally parallel to the plane of the reflector to a first configuration relative to the reflector and each other to provide a first signal beamwidth and adjusting the radiators in a direction generally parallel to the plane of the reflector to a second configuration relative to the reflector and each other to provide a second signal beamwidth.

In a preferred embodiment the method further comprises providing at least one beamwidth control signal for remotely controlling the position setting of the radiators. In the first configuration all radiators may be aligned with a center line of the reflector and in the second configuration alternate radiators are offset from the center line of the reflector in opposite directions. The method may further comprise providing variable beam tilt by controlling the phase of the RF signals applied to the radiators through a remotely controllable phase shifting network.

Further features and advantages of the present invention will be appreciated from the following detailed description of the invention.

DETAILED DESCRIPTION OF THE INVENTION

Reference will be made to the accompanying drawings, which assist in illustrating the various pertinent features of the present invention. The present invention will now be described primarily in solving aforementioned problems relating to use of plurality of mechanical phase shifters, it should be expressly understood that the present invention may be applicable in other applications wherein azimuth beamwidth control is required or desired. In this regard, the following description of a twin offset stagger, vertically and dually polarized antenna array equipped with shiftable radiating elements is presented for purposes of illustration and description. Furthermore, the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

Figure 1:
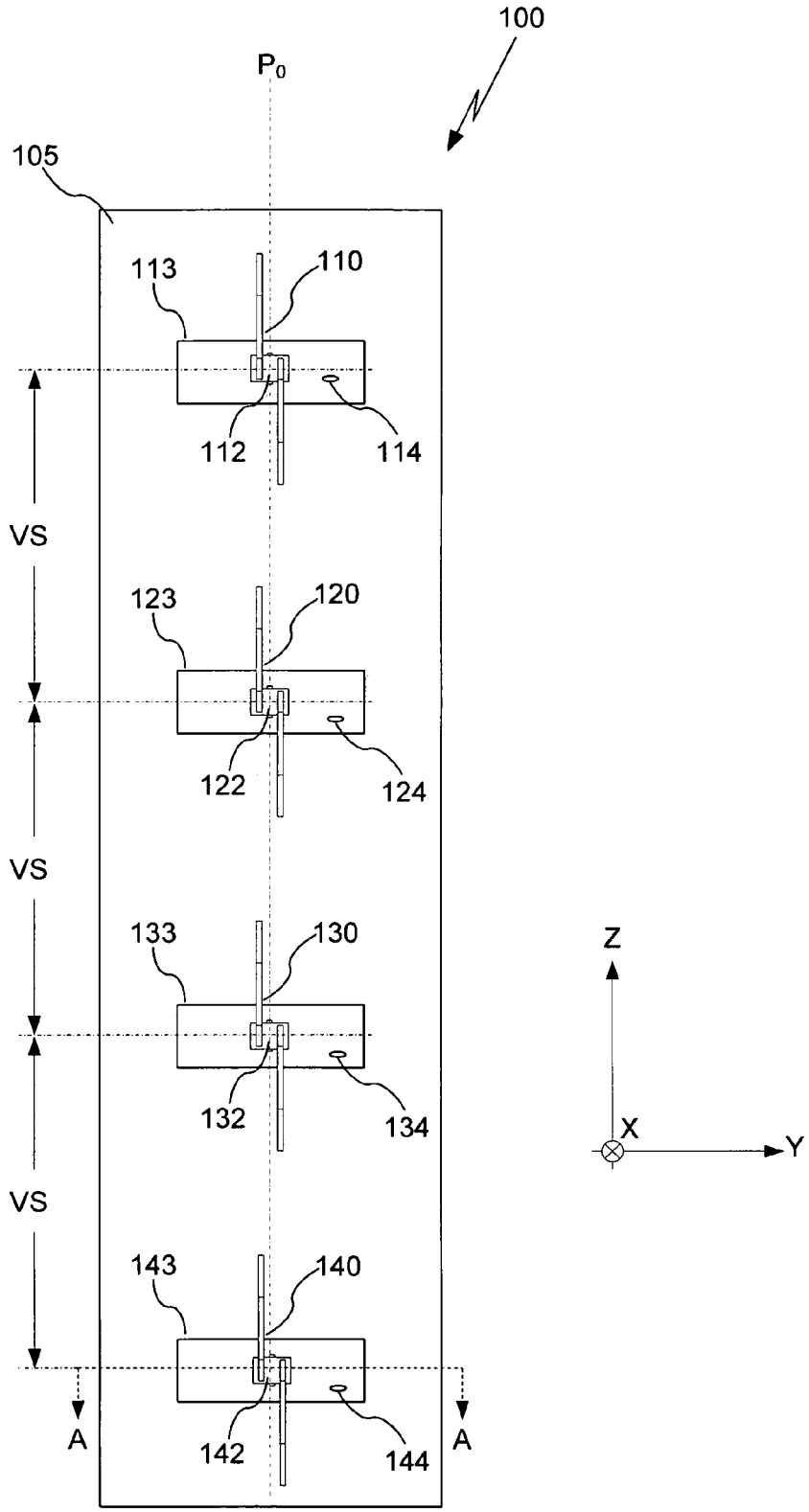
FIG. 1 is front view of a vertically polarized antenna array in wide azimuth beamwidth setting.

FIG. 1 shows a front view of a vertically polarized antenna array, 100, according to an exemplary implementation, which utilizes a conventionally disposed reflector 105. Reflector, 105 is oriented in a vertical orientation (Z-dimension) of the antenna array. The reflector, 105, may, for example, consist of an electrically conductive plate suitable for use with Radio Frequency (RF) signals. Further, reflector 105, plane is shown as a featureless rectangle, but in actual practice additional features (not shown) may be added to aid reflector performance.

Continuing with reference to FIG. 1 an antenna array, 100, contains a plurality of RF radiators (110, 120, 130, 140) preferably arranged both vertically and horizontally in a single column arrangement along primary vertical axis disposed on shift-able 114, 124, 134, 144 plates below the forward facing surface of the reflector 105 in the corresponding reflector orifices (113, 123, 133, 143). In particular, each RF radiator (110, 120, 130, and 140) is mounted on a feed-through (112, 122,132, 142) mount centrally disposed on a top surface of a shiftable foundation mount plate (114, 124, 134, 144) capable of controllable orthogonal movement relative to the main vertical axis limited by the peripheral dimensions of the corresponding reflector orifices (113, 123, 133, 143). Details pertaining to movable foundation mount plates (114, 124, 134, 144) and relating structures will become apparent upon examination of FIG. 2A and FIG. 2B.

Generally, in a broad beamwidth radiation pattern configuration RF radiators are preferably aligned along the common vertical axis labeled $P_0$ and are separated vertically by a distance VS. In one embodiment of the invention the plurality of RF radiators are separated by a distance VS in the range of ½λ-λ from one another where λ is the wavelength of the RF operating frequency. Examples of frequencies of operation in a cellular network system are well known in the art. For example, one range of RF frequencies may be between 806 MHz and 960 MHz. Alternative frequency ranges are possible with appropriate selection of frequency sensitive components. Preferably, the common axis $P_0$ is the same as center vertical axis of the reflector 105, plane. As illustrated in FIG. 1 common axis $P_0$ is equidistant from the vertical edges of the of the reflector 105, plane. For this nominal configuration stagger distance (SD) is defined by the following relationship:

$$SD=VS$$

Figure 3:
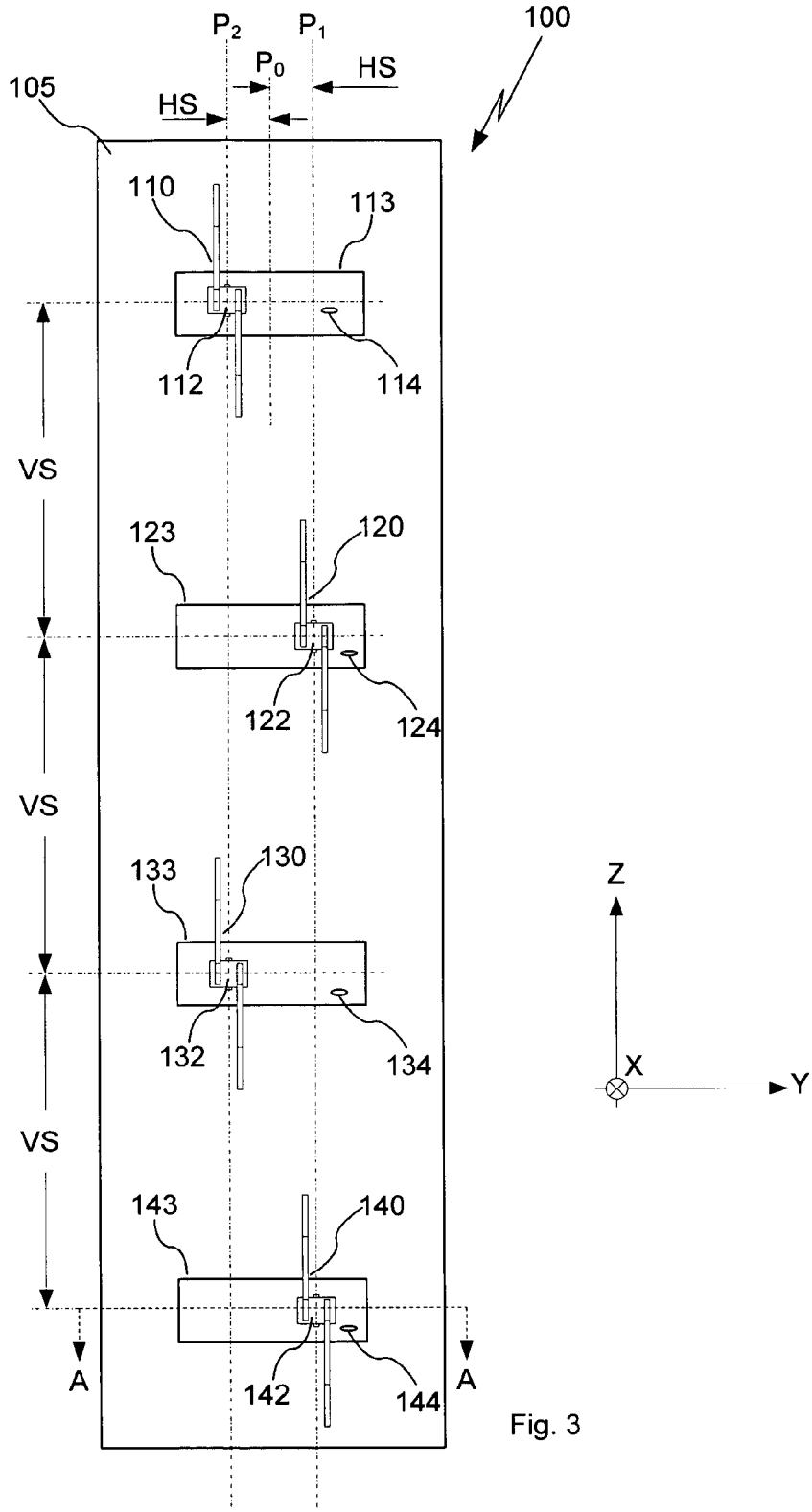
FIG. 3 is a front view of a vertically polarized antenna array in narrow azimuth beamwidth setting.

For a narrow azimuth radiation pattern RF radiator (110, 120, 130, and 140) are alternatively positioned as shown in FIG. 3. This position is characterized by stagger distance (SD) which for a particular setting can be defined by the following relationship:

$$SD=\sqrt{4HS^2+VS^2}$$

SD should preferably be less than 1λ. Through computer simulations and direct EM field measurement it was determined that azimuth radiation beam pattern can be deduced from the above formula. By varying HS dimensions desired azimuth beamwidth settings can be attained. VS dimension is typically fixed by the overall length of the reflector 105 plane which defines the effective antenna aperture. In the illustrative non-limiting implementation shown, RF reflector, 105, together with a plurality of vertically polarized dipole elements forms an antenna array useful for RF signal transmission and reception. However, it shall be understood that alternative radiating elements, such as taper slot antenna, horn, folded dipole, etc., can be used as well.

Figure 2A:
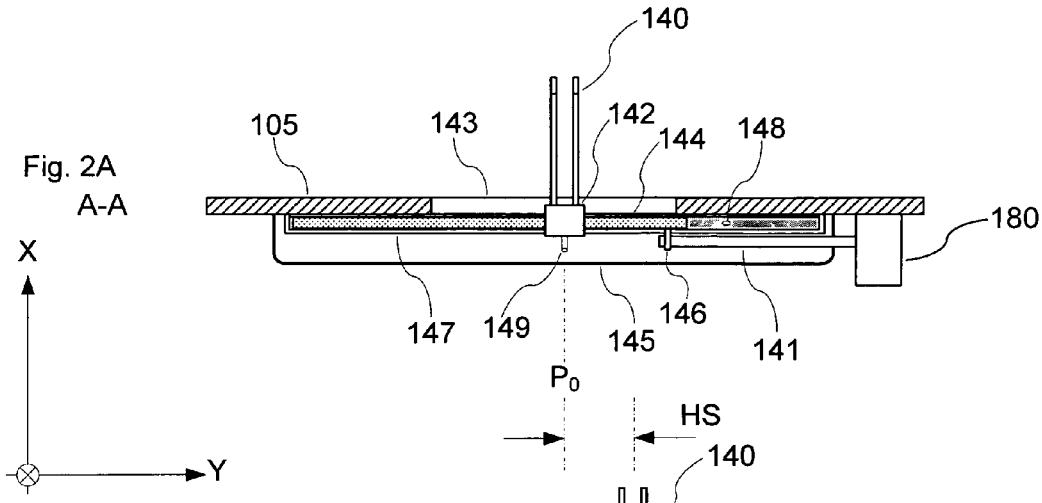
FIGS. 2A and 2B are cross sectional views along A-A datum detailing the motion of a vertically polarized antenna element in wide (FIG. 2A) and narrow (FIG. 2B) azimuth beamwidth setting.
Figure 2B:
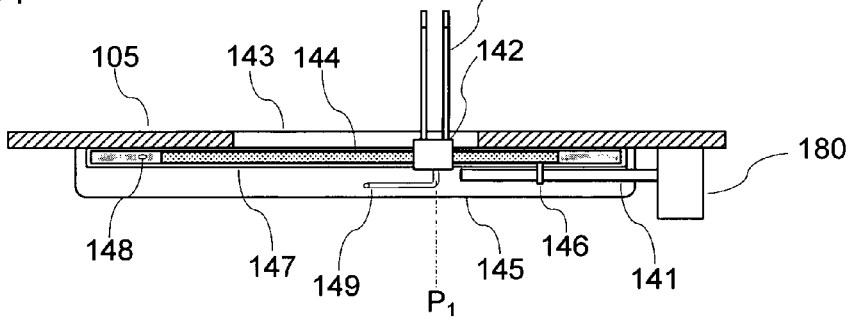
Figure 2C:
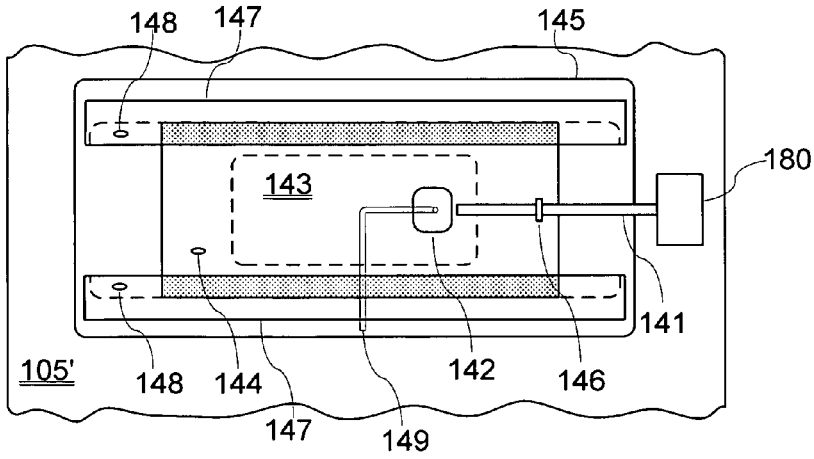
FIG. 2C is a back side view of the area immediate about the fourth radiating element with movable plate positioned as depicted in FIG. 2B.

A cross section datum A-A will be used to detail constructional and operational aspects relating to radiating elements relative movement. Drawing details of A-A datum can be found in FIG. 2A and FIG. 2B FIGS. 2A and 2B provide a cross sectional view along A-A datum. A-A datum, as shown in FIG. 1, bisects fourth 140 radiating element and associated mechanical structures. FIG. 2C provides a back side view of the area immediate of the fourth radiating 140 element. It shall be understood that all radiating elements share similar construction features, details being omitted for clarity. As shown in FIG. 2A a vertically polarized radiating element 140 is mounted with a feed-through 142 mount. A feed through 142 mount is preferably constructed out of a dielectric material and provides isolation means between radiating element 140 and movable 144 plate. Movable 144 plate is preferably constructed utilizing a rigid material as long as plate's top surface is comprised of highly conductive material, but alternatively can be constructed from aluminum plate and the like. The RF signal for each radiating 110, 120, 130, 140 element is individually supplied from a power dividing-combining 190 network with a suitable flexible radio wave 149 guide, such as flexible coaxial cable, and coupled to conventionally constructed feed through 142 mount terminals (details are not shown).

Movable foundation mount plate 144 is recessed and mounted immediately below the bottom surface of reflector 105 plane and supported with a pair of sliding 147 guide frames, on each side reflector orifice 143, having U-shaped slots 148 which provide X dimensional stability while providing Y dimensional movement to the movable foundation mount plate 144. As shown In FIG. 2C the back side of the movable foundation mount plate 144 and associated sliding 147 guide frames which are used for support are enclosed with a suitably constructed cover 145 to prevent undesirable back side radiation and to improve the front to back signal ratio.

Actuator 180 provides mechanical motion means to the jack screw 141. Jack screw rotation is coupled to a mechanical coupler 146 attached to the back side movable foundation mount plate 144. By controlling direction and duration of rotation of the jack screw 141 subsequently provides Y dimensional movement to the movable foundation mount plate 144. As it is well known in the art jack screw 141 is one of many possible means to achieve Y dimensional movement to the movable foundation mount plate 144. The mechanical actuator 180, or other well known means, may be extended to provide mechanical motion means to other or preferably all other jack screws 111, 121, 131 used to control motion of respective radiating 110, 120, 130, 140 elements.

The above description outlines basic concepts covering one radiating element, but it shall be understood that basic building elements can be replicated for each radiating element. In some instances it may be advantageous to combine or perhaps mirror mount mechanical assemblies into a single device as deemed appropriate for the application as will be appreciated by one skilled in the art.

Figure 4:
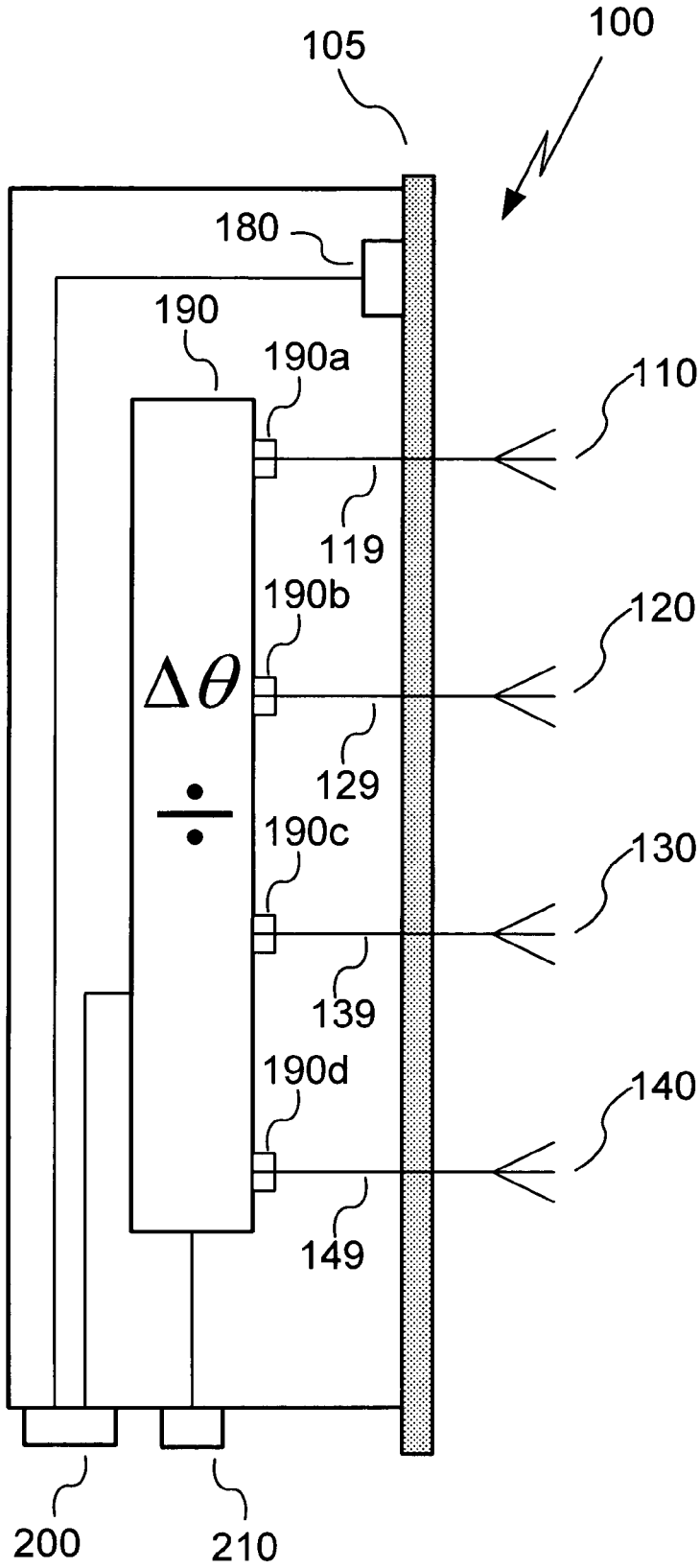
FIG. 4 is an RF circuit diagram of an antenna array equipped with a Phase Shifter and Power Divider.

With reference to FIG. 4 RF radiator (110, 120, 130, 140) elements may be fed from a master RF input port, 210, with the same relative phase angle RF signal through a conventionally designed RF power signal dividing-combining 190 network. RF power signal dividing-combining 190 network output-input 190(*a-d*) ports are coupled with a suitable radio wave 119, 129, 139, 149 guides, such as coaxial cable to corresponding radiating elements 110, 120, 130, 140. In some operational instances such RF power signal 190 dividing-combining network may include remotely controllable phase shifting network so as to provide beam tilting capability as described in U.S. Pat. No. 5,949,303 assigned to current assignee and incorporated herein by reference. An example of such implementation is shown in FIG. 4 wherein RF signal dividing-combining 190 network provides electrically controlled beam down-tilt capability. Phase shifting function of the power dividing network 190 may be remotely controlled via multipurpose control port 200. Similarly, azimuth beamwidth control signals are coupled via multipurpose control port 200 to a mechanical actuator(s) 180.

Figure 5A:
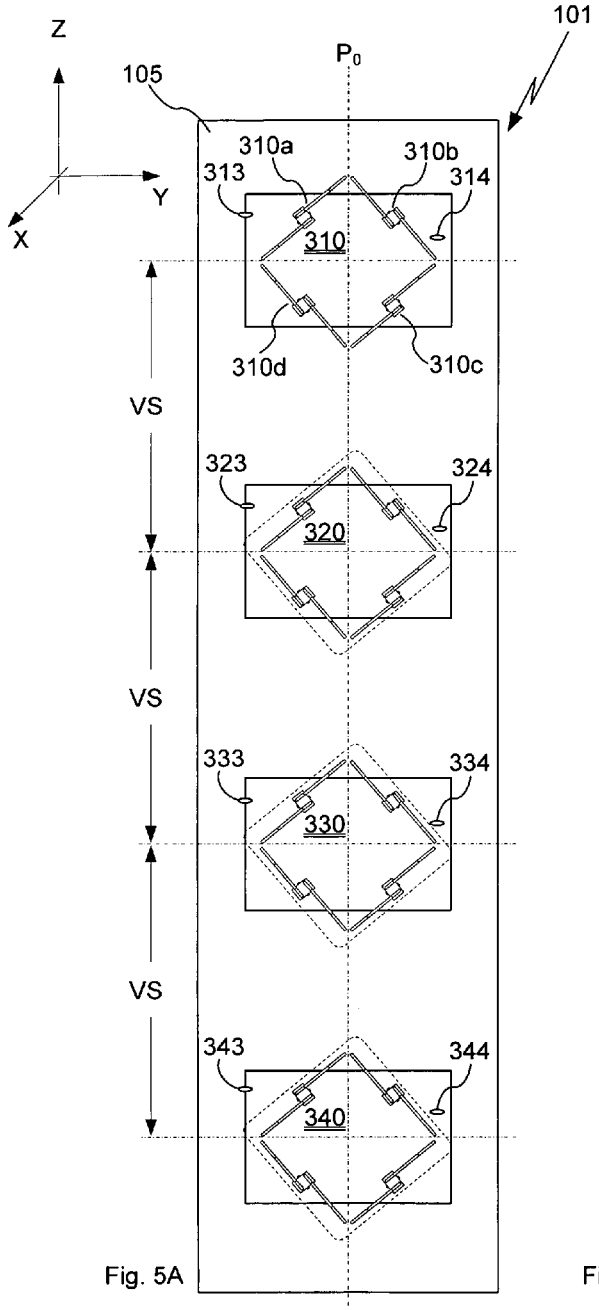
FIGS. 5A and 5B together present a front view of a dual polarized antenna array configured for wide (FIG. 5*a*) azimuth beamwidth setting and narrow (FIG. 5B) azimuth beamwidth setting.
Figure 5B:
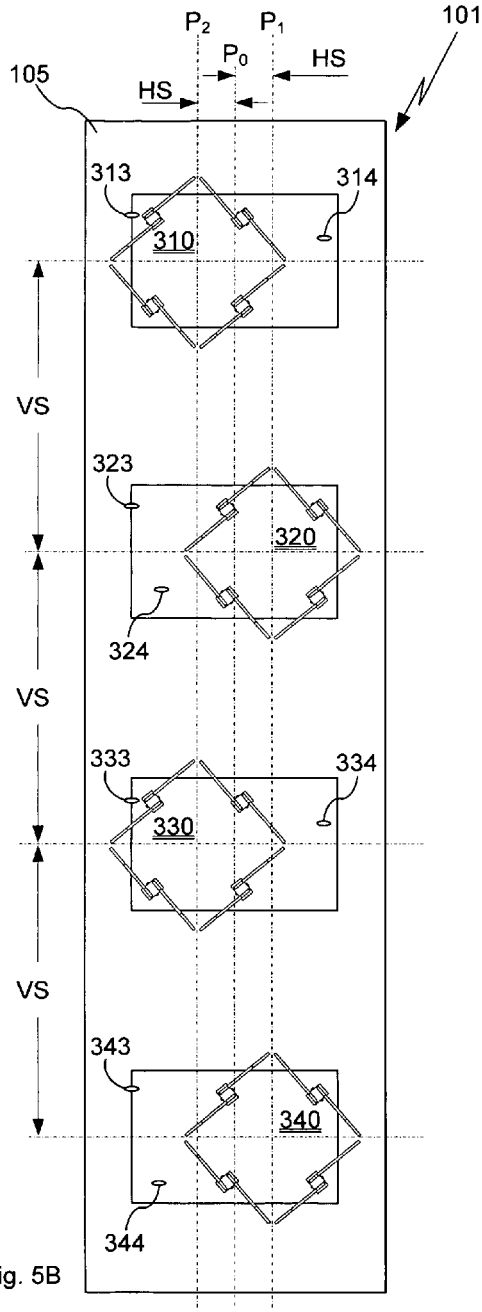

As described hereinabove a plurality of vertically polarized dipole 110, 120, 130, 140 elements together form an antenna array useful for RF signal transmission and reception. However, vertically polarized dipole 110, 120, 130, 140 elements can be replaced with a dual polarization radiating elements groups 310, 320, 330, 340 which may utilize discrete radiating elements such as patches, taper slot, horn, folded dipole, and etc. One such implementation using dipoles is shown in FIG. 5A and FIG. 5B wherein radiating elements groups 310, 320, 330, 340 are respectively mounted on movable foundation mount plates 314, 324, 334, 344. Movable foundation mount plates 314, 324, 334, 344 are recess mounted in corresponding radiator 105 plane orifices 313, 323, 333, 343. As shown in FIG. 5B movable foundation mount plates 314, 324, 334, 344 can be alternatively shifted relative to radiating elements groups 310, 320, 330, 340 center. For this configuration stagger distance (SD) is defined by the following relationship:

$$SD=\sqrt{4HS^2+VS^2}$$

Figure 6A:
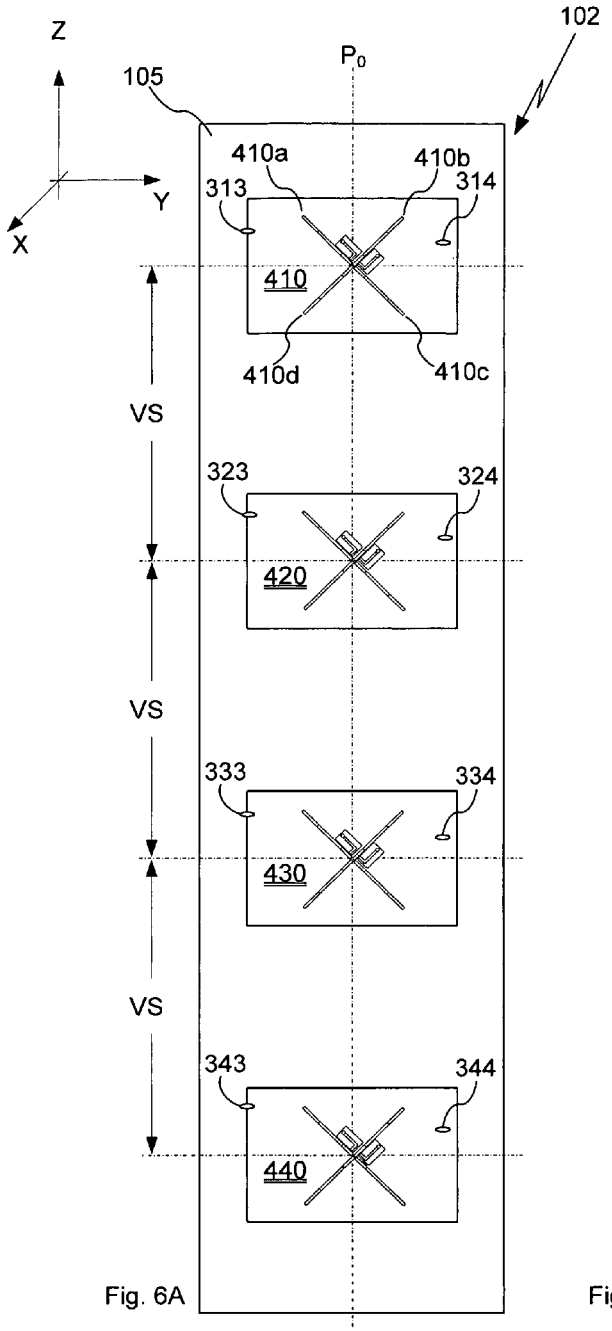
FIGS. 6A and 6B together present a front view of a dual polarized antenna array employing crossover dipole elements configured for wide (FIG. 6A) azimuth beamwidth setting and narrow (FIG. 6B) azimuth beamwidth setting.
Figure 6B:
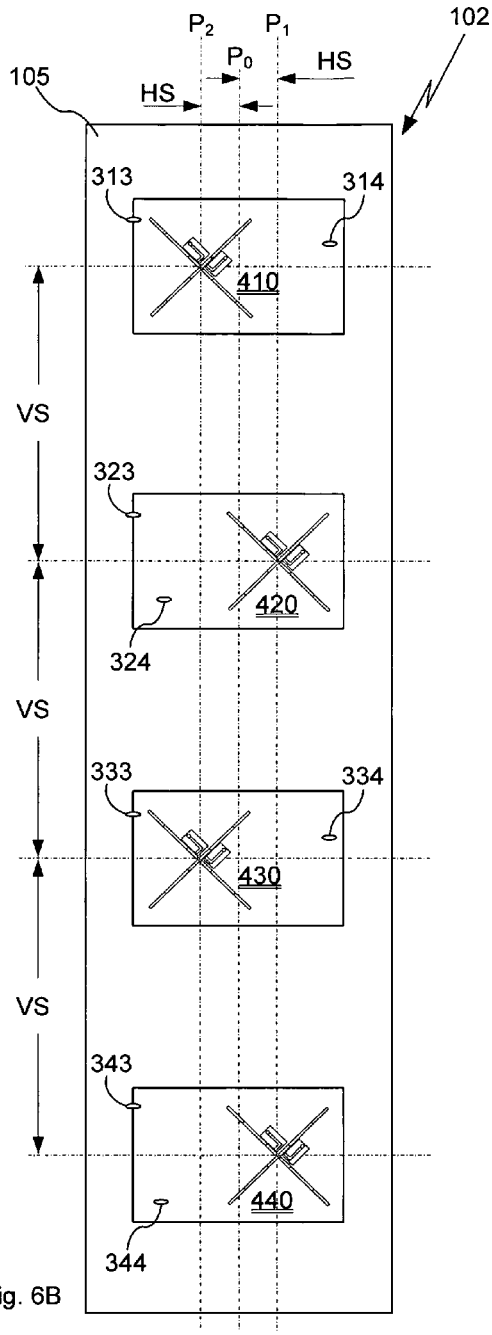

Conventional dipole radiating elements 310(*a-d*) as shown in FIG. 5A and FIG. 5B can be replaced with cross over dipole pairs wherein radiating elements groups 310, 320, 330, 340 are equivalently replaced with crossover dipole radiating elements groups 410, 420, 430, 440 respectively mounted on movable foundation mount plates 314, 324, 334, 344. The resulting configuration, as depicted in FIG. 6*a* and FIG. 6B generally operates in nearly identical manner as described hereinabove.

Figure 7:
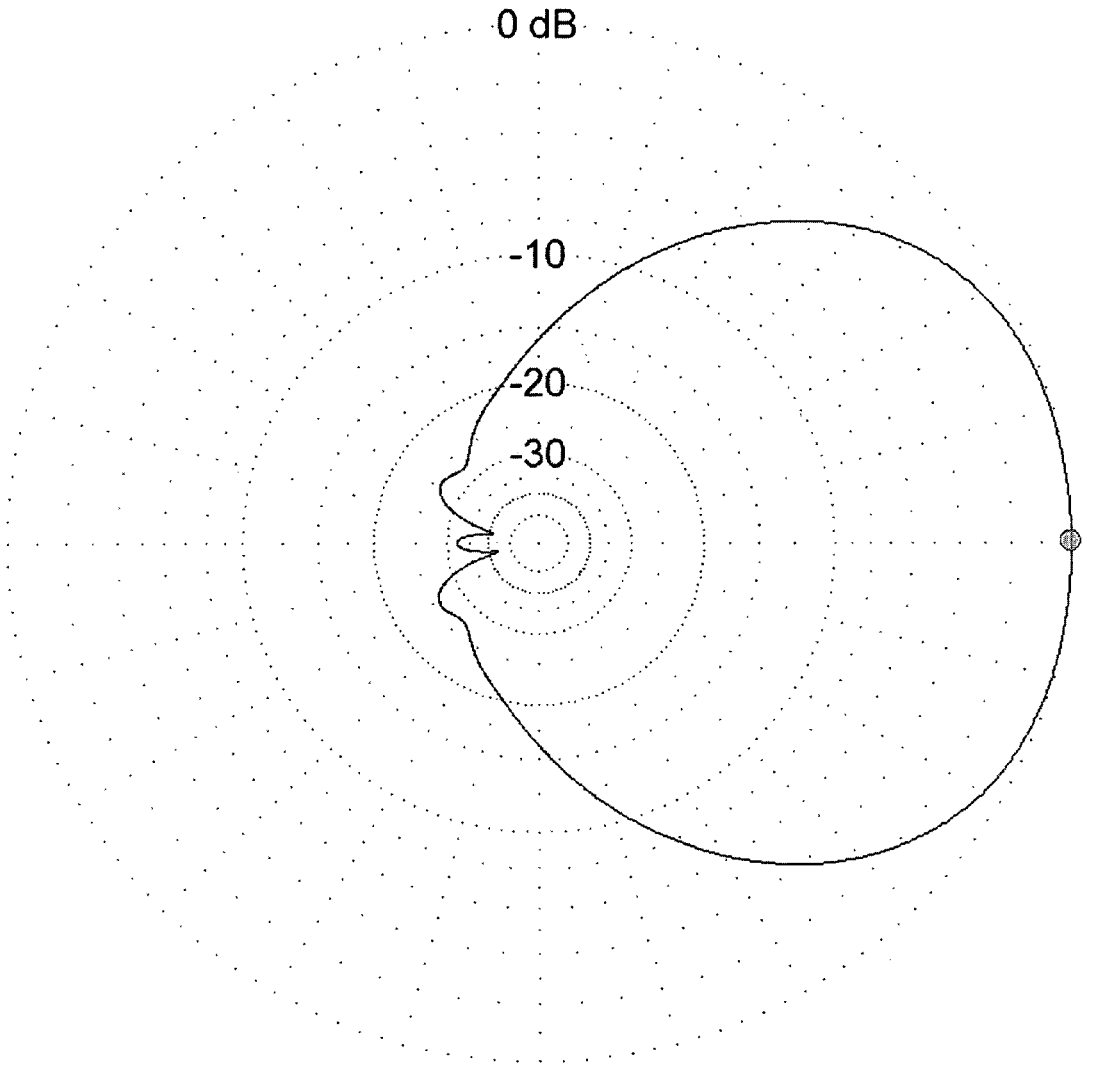
FIG. 7 depicts a wide azimuth radiation pattern corresponding to the FIG. 1 configuration (the radiation pattern for the embodiment of FIGS. 5A, 6A is similar).

Consider the following two operational conditions (a-b):

Operating condition (a) wherein all RF radiators (110, 120, 130, 140), as depicted in FIG. 1, are aligned about $P_0$ axis which is proximate to vertical center axis of the reflector 105 plane. Such alignment setting will result in relatively wide azimuth beamwidth as shown in the simulation of FIG. 7.

Figure 8:
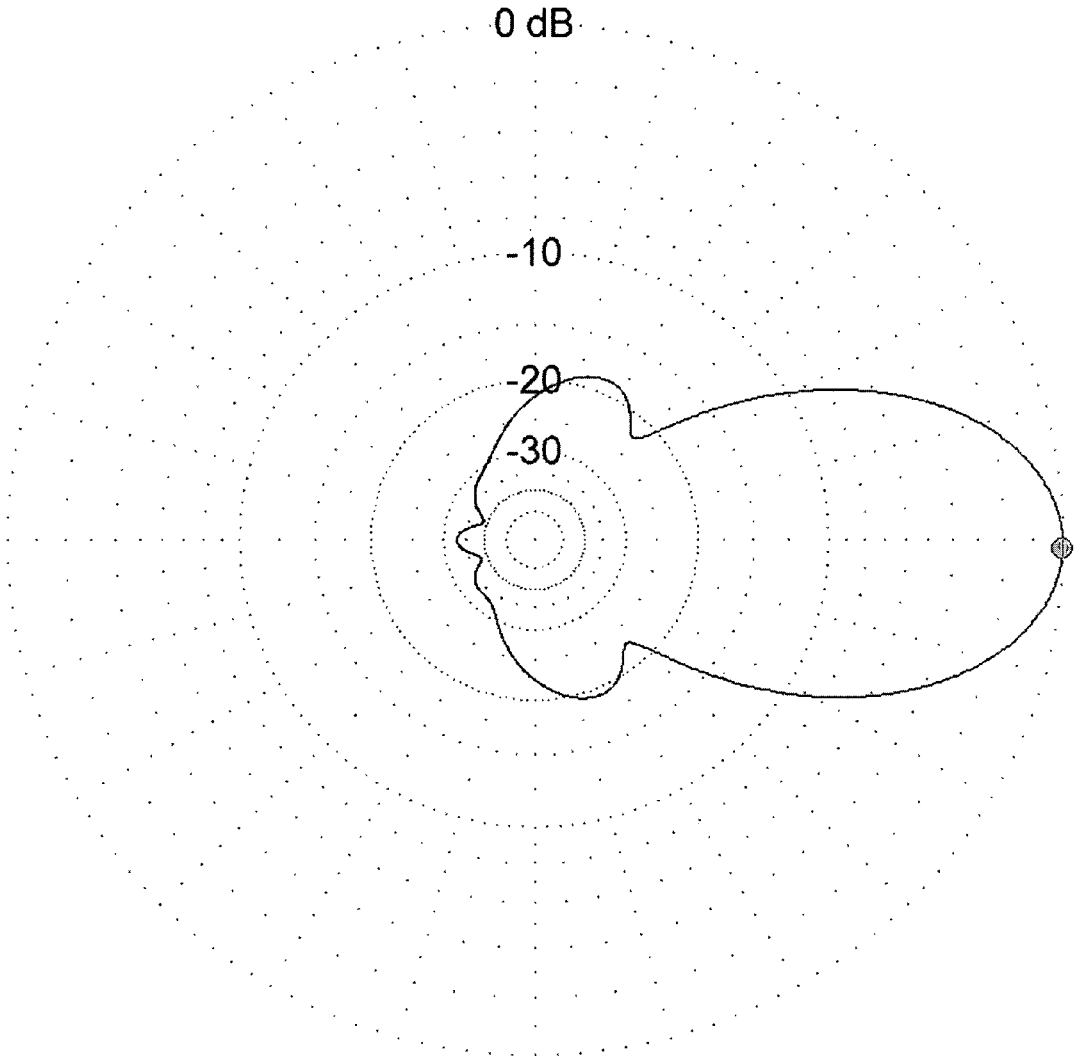
FIG. 8 depicts narrow azimuth radiation pattern corresponding to the FIG. 3 configuration (the radiation pattern for the embodiment of FIGS. 5B, 6B is similar).

Operating condition (b) wherein RF radiators (110, 120, 130, 140) as depicted in FIG. 3, are positioned in the following configuration:

The first group of RF radiators 120, 140 is positioned along $P_1$ axis and the second group of RF radiators 110, 130 is positioned along $P_2$ axis. Once all RF radiators (110, 120, 130, 140) are positioned the resultant azimuth radiation beamwidth will be narrower. Such alignment setting will result in a relatively narrow azimuth beamwidth as shown in the simulation of FIG. 8. Obviously, HS can be varied continuously from minimum (0) to a maximum value to provide continuously variable azimuth variable beamwidth between two extreme settings described hereinabove.

It will be appreciated from the foregoing that one embodiment of the invention includes a method for providing variable signal beamwidth by controlling positioning of the slidably mounted radiators relative to the reflector and each other. For example, the method may control beamwidth by setting the radiator positioning to a first position corresponding to operating condition (a) above wherein all RF radiators (110, 120, 130, 140), as depicted in FIG. 1, are aligned to obtain a relatively wide beamwidth setting. The method may further control beamwidth by setting the radiator positioning to a second position where the radiators are staggered, for example corresponding to operating condition (b) above to obtain a relatively narrow beamwidth. These first and second settings may of course be varied in between the example settings (a) and (b) in accordance with the beamwidth control signals to provide the desired beamwidth. The method of the invention may also provide variable beam tilt. In this embodiment of the invention variable beam tilt is provided by controlling the phase of the RF signals applied to the radiators through a remotely controllable phase shifting network such as described above in relation to FIG. 4.

Numerous modifications of the above described illustrative embodiments will be apparent to those skilled in the art, including alternative radiator position settings and frequency ranges of operation.

REFERENCE DESIGNATOR LIST

Ref Des Description

100 Vertical polarization movable stagger antenna array
101 Dual polarization movable stagger antenna array
102 Dual polarization movable stagger antenna array equipped with crossover dipole radiating elements
105 Antenna Reflector
110 First Radiating Element (in this case a dipole)
111 First jack screw
112 Feed-through mount
113 First Radiating Element Reflector orifice
114 First movable plate
115 First back cover
116 First mechanical coupler cover
117 Sliding guide frames
118 Sliding guide slot in a sliding guide frames
119 First Radiating Element feed line (coax) to RF power dividing and combining network
120 Second Radiating Element (in this case a dipole)
129 Second Radiating Element feed line (coax) to RF power dividing and combining network
130 Third Radiating Element (in this case a dipole)
139 Third Radiating Element feed line (coax) to RF power dividing and combining network
140 Fourth Radiating Element (in this case a dipole)
141 Fourth mechanical actuator coupling
142 Fourth pivoting joint
143 Fourth Radiating Element feed line to RF power dividing and combining network
140 Fourth Radiating Element (in this case a dipole)
141 Fourth jack screw
142 Fourth Feed-through mount
143 Fourth Radiating Element Reflector orifice
144 Fourth movable plate
145 Fourth back cover
146 Fourth mechanical coupler cover
147 Sliding guide frames
148 Sliding guide slot in a sliding guide frames
149 Fourth Radiating Element feed line (coax) to RF power dividing and combining network
180 Mechanical Azimuth Actuator
190 RF power dividing and combining network with integrated remote electrical tilt capability
190(*a-d*) RF power dividing and combining network to antenna coupling ports.
200 Multipurpose communication port
210 Common RF port
310 First dual polarization radiating element grouping.
310(*a-b*) Radiation elements used in first dual polarization radiating element group
313 First Radiating Element Reflector orifice for dual polarization group
314 First movable plate for dual polarization group
320 Second dual polarization radiating element grouping.
320(*a-b*) Radiation elements used in second dual polarization radiating element group
323 Second Radiating Element Reflector orifice for dual polarization group
324 Second movable plate for dual polarization group
330 Third dual polarization radiating element grouping.
330(*a-b*) Radiation elements used in third dual polarization radiating element group
333 Third Radiating Element Reflector orifice for dual polarization group
334 Third movable plate for dual polarization group
340 Fourth dual polarization radiating element grouping.
340(*a-b*) Radiation elements used in fourth dual polarization radiating element group
343 Fourth Radiating Element Reflector orifice for dual polarization group
344 Fourth movable plate for dual polarization group
410 First dual polarization radiating element grouping utilizing crossover dipoles.
420 Second dual polarization radiating element grouping utilizing crossover dipoles.
430 Third dual polarization radiating element grouping utilizing crossover dipoles.
440 Fourth dual polarization radiating element grouping utilizing crossover dipoles.

What is claimed is:

1. An antenna for a wireless network, comprising:
a generally planar reflector;
a first plurality of driven radiators driven by RF energy fed thereto; and
a second plurality of driven radiators driven by RF energy fed thereto;
wherein at least one of the first plurality of radiators and the second plurality of radiators are movable relative to the reflector in a direction generally parallel to the reflector plane, wherein the movable radiators are laterally movable from a first configuration where the first plurality of radiators and second plurality of radiators are all aligned to a second configuration where the first plurality of radiators and second plurality of radiators are staggered relative to each other, to provide variable signal beamwidth.

2. The antenna of claim 1, wherein the first and second plurality of radiators comprise vertically polarized radiating elements.

3. The antenna of claim 1, wherein the first and second plurality of radiators comprise dual polarization radiating elements arranged in groups of plural elements for each radiator.

4. The antenna of claim 1, wherein the first and second plurality of radiators comprise dual polarization cross over dipole radiating elements.

5. The antenna of claim 1, further comprising a first plurality of radiator mount plates coupled to the first plurality of radiators and slidable relative to the reflector and a second plurality of radiator mount plates coupled to the second plurality of radiators and slidable relative to the reflector.

6. The antenna of claim 5, wherein said reflector has a plurality of orifices and wherein said first and second plurality of radiator mount plates are configured behind said orifices.

7. The antenna of claim 6, wherein said first and second plurality of radiator mount plates comprise reflective material on the portion thereof facing the orifice.

8. The antenna of claim 5, further comprising one or more actuators coupled to the first and second plurality of radiator mount plates to slide the mount plates and attached radiators relative to the reflector.

9. The antenna of claim 8, further comprising a first and second plurality of guide frames coupled to the reflector adjacent said orifices and receiving the respective first and second plurality of radiator mount plates.

10. The antenna of claim 8, wherein the reflector is generally planar defined by a Y-axis and a Z-axis parallel to the plane of the reflector and an X-axis extending out of the plane of the reflector, and wherein the one or more actuators are configured to adjust Y-axis position of the first plurality of radiators and the second plurality of radiators in opposite directions.

11. The antenna of claim 10, wherein the reflectors in said first configuration are aligned along a center line of the reflector parallel to the Z-axis of the reflector and spaced apart a distance (VS) in the Z direction.

12. The antenna of claim 11, wherein the reflectors in said second configuration are offset in opposite Y directions from said center line of the reflector by a distance (HS) defining a stagger distance (SD) defined by the following relationship:

$$SD=\sqrt{4HS^2+VS^2}$$

13. The antenna of claim 12, wherein the distance (SD) is less than about 1λ, where λ is the wavelength of the RF operating frequency of the antenna.

14. The antenna of claim 8, further comprising a multipurpose control port receiving azimuth beamwidth control signals provided to said one or more actuators.

* * * * *